United States Patent [19]

Moisseeff

[11] Patent Number: 4,941,531

[45] Date of Patent: Jul. 17, 1990

[54] INTERNAL COMBUSTION ENGINE RADIATOR

[75] Inventor: Igor Moisseeff, Myrtle Bank, Australia

[73] Assignee: Moisseeff Advanced Technology, Limited, Perth, Australia

[21] Appl. No.: 266,778

[22] Filed: Nov. 3, 1988

[51] Int. Cl.[5] ..... F28D 21/00

[52] U.S. Cl. ..... 165/125; 165/176

[58] Field of Search ..... 165/122, 125, 176

[56] References Cited

U.S. PATENT DOCUMENTS

| | | | |
|---|---|---|---|
| 2,368,732 | 2/1945 | Wallgren | 165/125 X |
| 2,707,096 | 4/1955 | Koopmans | 165/176 X |
| 2,973,944 | 3/1961 | Etter . | |
| 3,800,866 | 4/1974 | Ireland et al. | 165/122 |
| 3,884,297 | 5/1975 | Fegraus et al. | 165/158 X |
| 4,062,401 | 12/1977 | Rudny et al. | 165/153 X |
| 4,069,670 | 1/1978 | Bratt et al. | 165/176 X |
| 4,116,171 | 9/1978 | Schulmeister et al. | 165/125 X |
| 4,180,130 | 12/1979 | Beck et al. | 165/125 X |
| 4,184,541 | 1/1980 | Beck et al. | 165/125 |
| 4,687,053 | 8/1987 | Paulus et al. | 165/133 |

FOREIGN PATENT DOCUMENTS

| | | | |
|---|---|---|---|
| 0036213 | 9/1981 | European Pat. Off. | 137/125 |
| 0193423 | 9/1986 | European Pat. Off. . | |
| 2754101 | 7/1978 | Fed. Rep. of Germany . | |
| 1386314 | 3/1975 | United Kingdom . | |

*Primary Examiner*—Gerald A. Michalsky

*Attorney, Agent, or Firm*—McAulay, Fisher, Nissen & Goldberg

[57] ABSTRACT

A cylindrical heat exchange or radiator, one end of the cylinder being provided with a pair of concentric manifolds. A water inlet is connected to one manifold and a water outlet is connected to the other manifold. The manifolds are connected to a plurality of longitudinally extending heat exchange members and each member is provided with a water flow path therein so that water flows from one manifold through the flow path to the next manifold. The other end of the cylinder is connected to a fan to cause air to flow over the members and out through an opening adjacent the two manifolds.

10 Claims, 3 Drawing Sheets

INTERNAL COMBUSTION ENGINE RADIATOR

This invention relates to an improved heat exchanger, more particularly to a heat exchanger which may be employed as a radiator to cool the cooling water of an internal combustion engine.

Radiators for internal combustion engines as applied to motor vehicles are usually situated at the front of the vehicle whereby an air flow is caused to pass through the radiator, this air flow being assisted by a fan or fans. The radiator usually comprises an upper header tank and a lower header tank, the tanks being connected by vertical tubes to which fins are attached, the water flowing from the upper tank to the lower tank and being cooled by the air flow over the fins and tubes.

It is an object of the invention to provide an improved heat exchanger or radiator for an internal combustion engine which is of small and compact design and need not be positioned in the front of the vehicle which in normal situations the radiator does limit the aerodynamic shape of the front of the vehicle.

Thus the present radiator or heat exchanger can be positioned anywhere in the engine compartment and the air flow from this can if desired be taken directly to the interior of the vehicle for heating of the vehicle.

Thus there is provided according to the invention an improved heat exchanger, the heat exchanger being generally of cylindrical configuration, one end of the cylinder being provided with a pair of concentric manifolds, the inner manifold being spaced from the outer manifold, a water inlet connected to one manifold, and a water outlet connected to the other manifold, the manifolds being joined to a plurality of longitudinally heat exchange members, and each member being provided with a water flow path therein, so that the water flows from one manifold through the flow path to the next manifold, the other end of the cylindrical member being connected to or having incorporated thereon a fan to cause air to flow over the members and out through an opening or openings adjacent the two manifolds.

In accordance with a further form of the invention, there is provided a heat exchanger or radiator for a motor vehicle engine, the radiator comprising a cylindrical water tank having an inlet tube extending from a first end to adjacent the opposite end of the tank, an outlet adjacent the inlet tube a the first end, internal and external fins on the surface of the tank, an air chamber surrounding said tank, an air inlet at one end of the chamber, and an air outlet at the other end of thee chamber.

Figure 1:
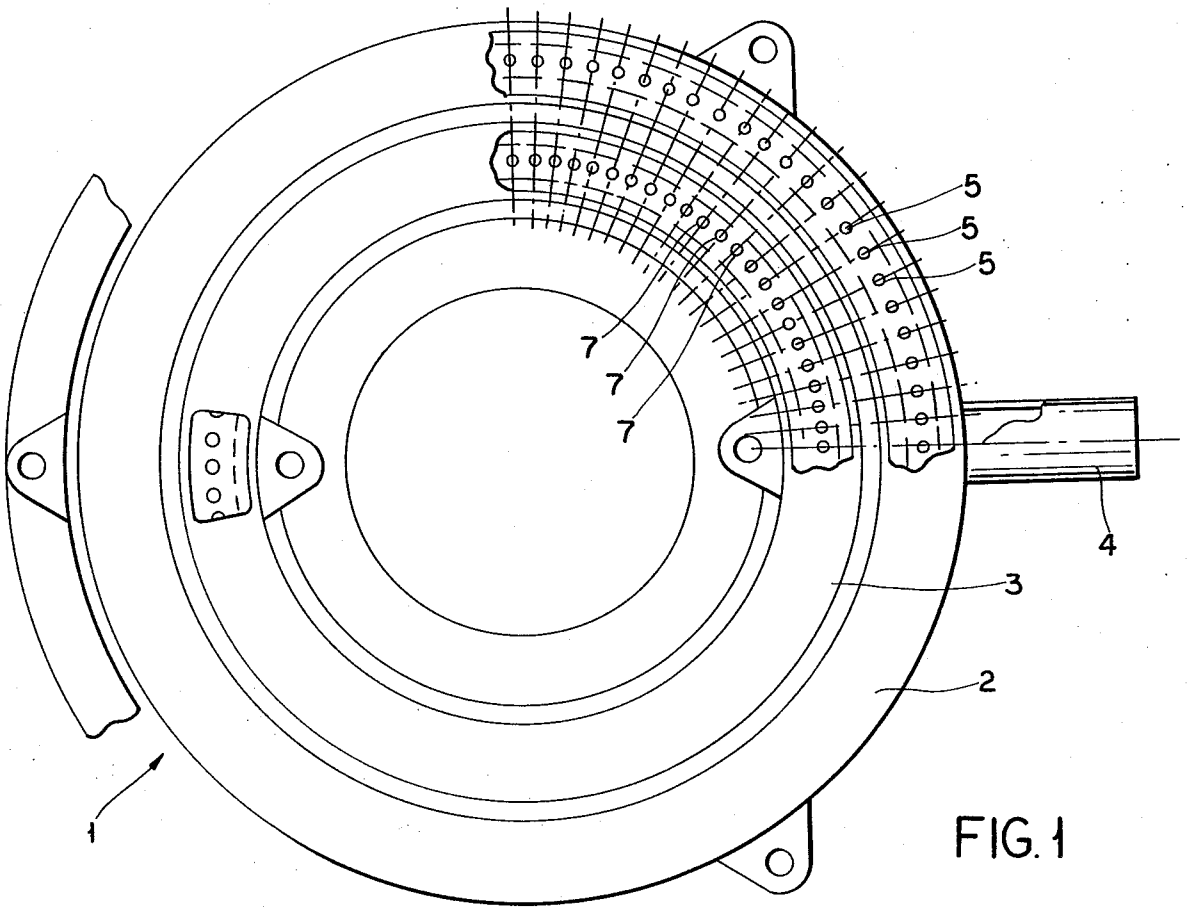
Figure 2:
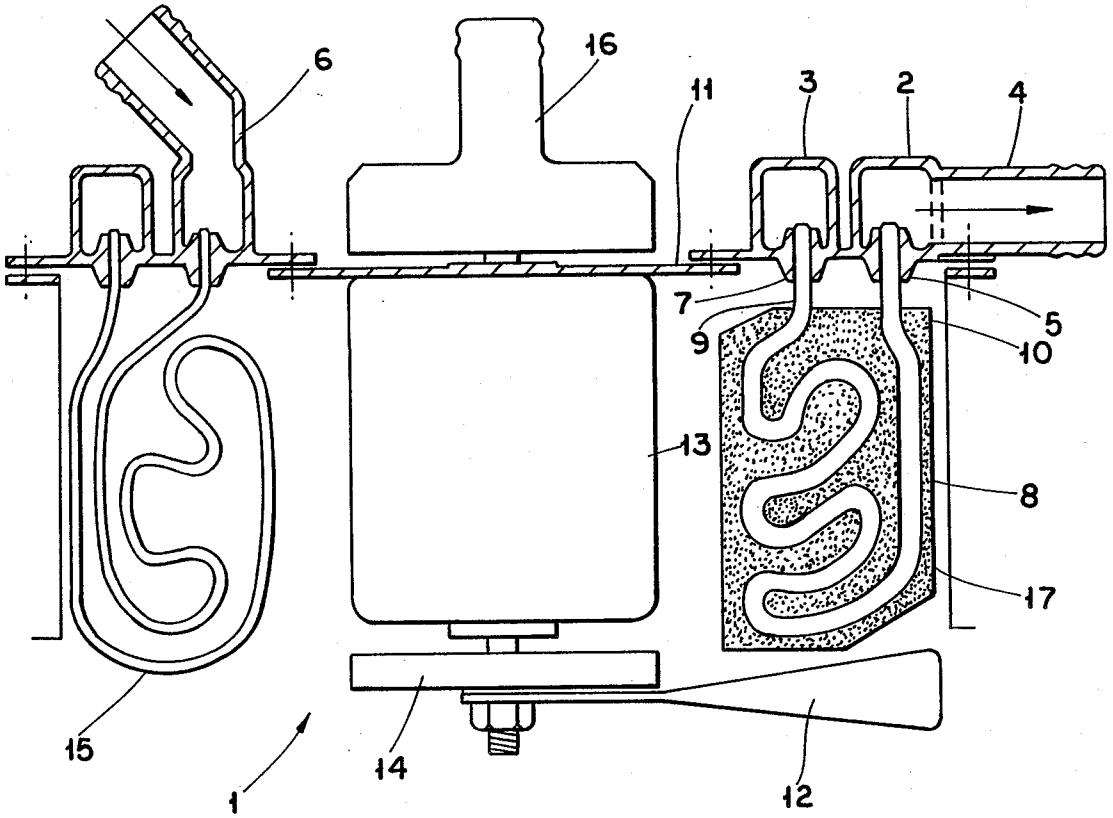
Figure 3:
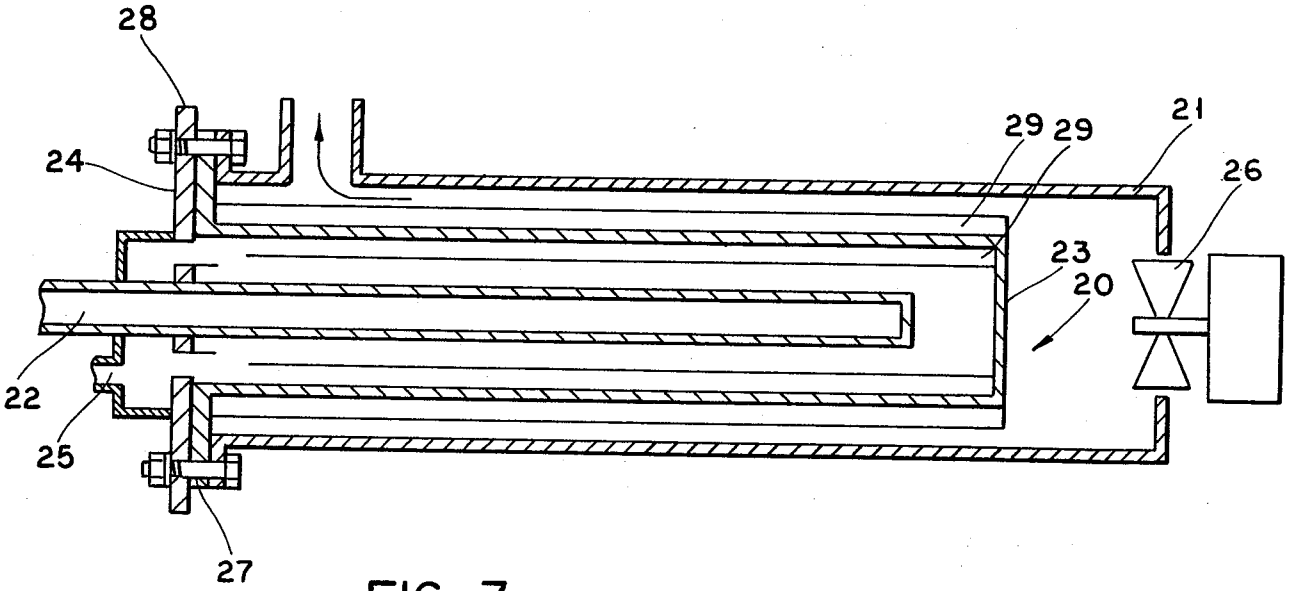

In order to more fully describe the invention reference will now be made to the accompanying drawings in which:

FIG. 1 is a plan view of one form of the invention, portions being omitted or cut away for clarity, FIG. 2 is a schematic view in cross-section of FIG. 1 showing two alternative forms of the invention, and FIG. 3 is a sectional view of a further form of the invention.

In a preferred form of the invention as shown in FIGS. 1 and 2, the radiator 1 is preferably of cylindrical shape, one end of the radiator being provided with a pair of circular manifolds 2, 3.

These manifolds are concentrically arranged and the outer manifold 2 is in the form of an annulus, this manifold being hollow, having a water connection 4 extending from the manifold.

On the surface of the manifold 2 there are provided a plurality of holes 5, these holes being concentrically arranged around the manifold.

The second manifold 3 is spaced inwardly of the first manifold and this can either be a further annulus or a circular manifold, this also being hollow and being provided with a water connection 6.

Also on the surface of the manifold 3 there are provided a plurality of holes 7, these corresponding in number to the number of holes 5 in the outer manifold.

These inner holes are preferably arranged in one concentric circle, but may be arranged in two concentric circles.

A plurality of radial plates 8, thus interconnect these holes, each plate having inlet and outlet tubes 9 and 10 to connect to respective holes 7 and 5. The plates 8 extend radially and also longitudinally of the radiator, each of these plates being formed with or having incorporated therein a water passage, the respective ends of the passages being connected to the tubes 9 and 10 and to the respective holes 7 and 5 in the two manifolds 3 and 2.

Each plate 8 can comprise a pair of metal sheets, each sheet having formed thereon a depression or groove 17 by bending or forming the sheet of metal, these grooves preferably being of a tortuous path, and each respective sheet is formed with a corresponding groove so that when the sheets are positioned in face to face relationship the two mating grooves thus form the path for the flow of water.

The plates can be formed of any suitable material, such as copper, aluminium, stainless steel or the like and are suitably joined together such as by soldering, welding or any other means.

In order to connect the plates to the holes in the manifold, there are provided small tubes or pipes 9 and 10, respective ends of which fit into the holes in the manifold and the end of the passage in the plate.

As noted above the holes in the inner manifold may be provided in two concentric circles, and this is done to allow a sufficient body of metal to be between the respective holes in the inner manifold.

The end of the radiator can be provided with a circular cover end plate 11, this having an opening therein so that a flow of air can pass therethrough, down past the plates, and then out through an annular passage between the manifolds, and also the central opening if the inner manifold is also of annular configuration.

In order to provide the flow of air, a fan 12 driven by an electric motor 13 is supported by the end plate 11, this fan either being an axial flow fan, centrifugal fan or radial flow fan.

The fan is preferably driven by the electric motor, and may be mounted onto the radiator, or may be mounted separately from the radiator and connected thereto by a duct. An electro-magnetic clutch 14 may be provided between the electric motor 13 and fan 12.

Thus as the water flows from one manifold, through the passage in the various plates, and back through the manifold a large cooling area is provided, the plates providing for the transmission of heat from the water to the air flowing past the plates.

The air issuing from the radiator can be directed back to atmosphere or over part of the internal combustion engine for cooling thereof, or this air can be directly ducted or a portion thereof ducted to the interior of the vehicle for heating of the interior of the vehicle.

As shown in the drawings, a water pump 16 can also be driven by the electric motor 13, the connections of the pump to the manifolds not being shown.

Also in this invention provision can also be made for the cooling of the transmission oil, and in this respect one or more of the plates can be connected to the flow of transmission oil, the respective manifolds being suitably formed to respective inlets and outlets, the manifolds being made with suitable internal separating walls for this purpose.

Alternatively, the inlets and outlets of each of these plates can be connected directly to the transmission oil without passing through the manifold.

The form of the path of the water flow through the plates can be varied, and in another form of the invention as shown in the left side of FIG. 2, the water path could be provided by a copper tube 15 or the like, to which fins or plates can be attached to increase the cooling area.

In an alternative form of the invention, as shown in FIG. 3, water tank 20 is situated in an air chamber 21, the water tank having an inlet tube extending toward a closed end 23 of the tank from an open end 24 of the tank, and has an outlet 25 also from the open end of the tank 20. The water tank is inserted in the air chamber 21, a fan 26 being provided at one end of the air chamber to pass pressurized air over the water tank.

Thus the air chamber, in one form of the invention, can be such that it has an open end, with a fan being positioned at the other end. The water tank 20 is also closed at one end 23 and open at one end 24, the open end 24 having a flange 27 which is adapted to be sealed to the open end of the air chamber 21. The water tank is itself closed by a closure plate 28, which is itself attached to the flange of the water tank, the two flanges of the air chamber and the water tank and the plate being thus bolted together.

Through the plate there is provided the hot water inlet pipe 22 which passes toward the closed end of the water tank, the outlet 25 for the cooled water being provided also in the closure plate.

The water tank itself can be formed of any suitable material, preferably a material having high conductivity and in order to increase the surface contact area, the water tank can be formed on its inside surface and/or its outside surface with fins 29 or have the wall thereof formed in convoluted or corrugated form, these corrugations running axially along the length of the tank.

The air chamber and air flow from both embodiments can have one or more outlets, and in one form of the invention one of the outlets can be connected to the carburettor to thus warm the air before passing to the carburettor, and also the fan would pressurize this air to thus give a form of turbo-charging.

If another outlet is provided this can also be connected either to the interior of the vehicle for the heating of the interior of the vehicle, or alternatively the air can be discharged to atmosphere.

Thus the hot water which is obtained from the block of the engine through the normal thermostat, passes along the inlet tube through the heat exchanger and then passes back to be recirculated back through the engine itself.

In a further form of the invention, the water tank may be the outer tank and an air chamber may be positioned within the water tank, the water tank having an inlet end at one end and an outlet end at the other end. In a construction similar to the above the air chamber can be inserted into the water tank, this air chamber having walls which are convoluted or corrugated or the like, these extending axially along the wall of the air chamber, and within the air chamber there is provided an air inlet pipe connected to a fan, the fan thus causing air to flow down the inlet pipe to the closed end of the air chamber and then be exhausted out either for use in the engine by being fed to the carburettor as a supercharging form, or be passed to the interior of the vehicle for heating, or be passed to atmosphere, or a combination of these.

In an alternative form of the invention the tank has in it passages arranged to have an air flow therethrough and these passages may be in the nature of U-shaped tubes or the like which extend along within the radiator tank but are arranged to have an air flow therethrough, a header at one end of the radiator tank preferably having an air intake duct formed in it to allow air to be drawn into the ducts within the radiator tank and having a second duct associated with the other ends of the tubes so that air can flow in through an air intake duct, through the tubes and out again through the air outlet duct, the air outlet duct however being associated with a fan and driving means therefor so that there is a forced flow of air through the tubes in the radiator tank and out, the outlet preferably being connected with the carburation system of the vehicle so that the device acts to preheat the air flowing to the inlet manifolds of the engine but also allowing some amount of supercharging due to the fan which, if required, can be in a multi-stage form to act as an efficient supercharger for the engine and at the same time of course draining the air through the tubes in the radiator tank to collect the heat from the coolant which is being pumped through the tank to thereby give a highly efficient heat transfer between the incoming air and circulating coolant in the radiator tank.

It will be realized that efficiency can be improved by arranging the air flow direction in the tubes in the radiator tank in relation to the direction of water flow to ensure the highest heat transfer.

The fan can be regulated by thermostat or similar means and can be driven at a speed where the coolant circulating through the radiator tank is kept at the best temperature for engine operation, and it will be realized that such an arrangement allows rapid heating of the coolant in the engine at starting, if this is required, because the air flow can be readily regulated, and as the air is drawn through the radiator tubes by a controlled fan maximum conditions can be achieved under all engine temperature and ambient conditions.

I claim:

1. A cylindrical heat exchanger, particularly for the cooling of an internal combustion engine, one end of the heat exchanger being provided with a pair of concentric manifolds, one of said manifolds being an inner manifold and radially spaced from the other manifold which is an outer manifold;

a water inlet connected to one of the manifolds and a water outlet connected to the other manifold;

a plurality of radially spaced heat exchange members extending longitudinally of the heat exchanger between said pair of manifolds and the other end of said heat exchanger, each said heat exchange member having a water flow path therein;

said flow path having an inlet and an outlet;

said inlet being connected to said one manifold and said outlet being connected to said other manifold; and an axial flow fan at said outer end of said heat exchanger and mounted axially thereof to cause a flow of air to pass longitudinally of said heat exchanger over said heat exchange members and out through an opening adjacent to said two manifolds.

2. A heat exchanger as defined in claim 1, wherein the heat exchange members each comprise two mating plates, each plate having a groove formed therein, the grooves of the two plates matching so that when the plates are mated, a continuous channel is formed, each end of the channel opening to an end of the mated plates.

3. A heat exchanger as defined in claim 2, wherein the end of said channel is connected to said one manifold and the other end of said channel is connected to said other manifold.

4. A heat exchanger as defined in claim 1 wherein the heat exchange members each comprise a copper tube attached to a heat conductive plate.

5. A heat exchanger as claimed in claim 1, wherein the heat exchanger members are arranged in a circular array, an electric motor being positioned in the centre of said circular array for driving said fan.

6. A cylindrical heat exchanger, particularly for the cooling of an internal combustion engine, one end of the heat exchanger being provided with a pair of concentric manifolds, one of said manifolds being an inner manifold and radially spaced from the other manifold which is an outer manifold;

a water inlet connected to one of the manifolds and a water outlet connected to the other manifold;

a plurality of radially spaced heat exchange members extending longitudinally of the heat exchanger between said pair of manifolds and the other end of said heat exchanger, each said heat exchange member having a water flow path therein;

said flow path having an inlet and an outlet;

said inlet being connected to said one manifold and said outlet being connected to said other manifold; and an axial flow fan at said other end of said heat exchanger and mounted axially thereof to cause a flow of air to pass longitudinally of said heat exchanger over said heat exchange members and out through openings adjacent to said two manifolds.

7. A heat exchanger as defined in claim 6, wherein the heat exchange members each comprise two mating plates, each plate having a groove formed therein, the grooves of the two plates matching so that when the plates are mated, a continuous channel is formed, each end of the channel opening to an end of the mated plates.

8. A heat exchanger as defined in claim 7, wherein the end of said channel is connected to said one manifold and the other end of said channel is connected to said other manifold.

9. A heat exchanger as defined in claim 7, wherein the heat exchange members each comprise a copper tube attached to a heat conductive plate.

10. A heat exchanger as claimed in claim 7, wherein the heat exchange members are arranged in a circular array, an electric motor being positioned in the centre of said circular array for driving said fan.

* * * * *